US006400083B1

(12) United States Patent
Keim et al.

(10) Patent No.: US 6,400,083 B1
(45) Date of Patent: Jun. 4, 2002

(54) FLUORESCENT LAMP WITH BI-PIN BASE INSULATOR

(76) Inventors: Peter Keim, Anjerlaan 7, Oostkapelle (NL), 4356JC; Robert Minderhout, De Walestraat 24, Koudekerke (NL), 4371CD; Jacobus C. Peuchen, 309 S. Kansas, Assaria, KS (US) 67416; Harish F. Gandhi, 1128 Steeplechase Dr., Morgantown, WV (US) 26508

( * ) Notice: Subject to any disclaimer, the term of this patent is extended or adjusted under 35 U.S.C. 154(b) by 0 days.

(21) Appl. No.: 09/329,393

(22) Filed: Jun. 10, 1999

(51) Int. Cl.[7] ..... H01J 5/50

(52) U.S. Cl. ..... 313/634; 313/318.02; 313/318.08; 313/318.05

(58) Field of Search ..... 439/612, 617; 313/634, 317, 318.01, 318.02, 624, 625, 626

(56) References Cited

U.S. PATENT DOCUMENTS 2,386,190 A * 10/1945 Betts ..... 439/617
6,002,200 A * 12/1999 Keim et al. ..... 313/318.02

FOREIGN PATENT DOCUMENTS

| | | | |
|---|---|---|---|
| GB | 646553 | 11/1950 | ..... 38/3 |
| GB | 816229 | 7/1959 | ..... 38/3 |

* cited by examiner

*Primary Examiner*—Vip Patel
*Assistant Examiner*—Ken A Berck

(57) ABSTRACT

An electric lamp is provided with an end having an annular recess which contains an insulating member which is secured to the lamp by means of at least two conductors which each extend from the lamp through an aperture in the insulating member. The insulating member and the annular recess are so shaped that the insulating member is held against rotation and lateral displacement with respect to the lamp. The insulating member has cut-out portions remote from its ends, preferably in a central portion, and most preferably configured to have two substantially octagonal portions connected by a portion in the shape of a rectangle, through which cut-out portions underlying material of the annular recess is exposed.

7 Claims, 2 Drawing Sheets

FLUORESCENT LAMP WITH BI-PIN BASE INSULATOR

FIELD OF THE INVENTION

This invention relates to electric lamps having an end which comprises an insulating member element secured by means of electrode-supply conductors and locked against rotation and lateral displacement with respect to the lamp.

BACKGROUND OF THE INVENTION

In Great Britain Specification No. 816,229 and 646,553, there are disclosed electric lamps or discharge tubes having a base which comprises a metal shell having an insulating member of insulating material disposed on a surface thereof, for example, in a recess which supports terminal contacts or bi-pins that are connected in an electrical lamp, for example, a fluorescent lamp, and filling the space between the conductor pins and the recess. In such a lamp, the ends may be moldable, and the insulating member may be moldable or may be simply affixed to the metallic shell. The insulating members or contact-carrying plates are preferably located in a recess of the metal shell and may be of various shapes, for example, as described in Great Britain Patent Specification 646,553, wherein an insulating disc or contact-carrying plate fits into a circular annular recess, and as in Great Britain Patent Specification 816, 229 wherein the end comprises a metal shell provided with an in turned deformable flange defining an aperture and a disc of moldable insulating material disposed within the aperture. The insulating member plate or disc carries the contacts and is adapted to elastically take up shocks and transmit the same at a region of particular strength as a result of the annular recess, thus greatly reducing the risk of damaging the end.

In the lamp of Great Britain Patent Specification 646,553, the insulating member 12 is a disc molded into the metallic shell 11. In the lamp of Great Britain Patent Specification 816,229, the insulating member is a contact-carrying plate 8 and fits into a circular, annular recess or it may be octagonal in shape and fits into an octagonal annular recess. In both configurations, the insulating member is substantially the same size as the shell or recess.

In modern discharge lamps, a bi-pin insulating member as currently used, in, for example, fluorescent lamp bases, uses a relatively large amount of insulating material. As illustrated in FIGS. 3 and 5 herein, such an insulating member is primarily rectangular in shape with chamfered corners and has two small apertures for fixation of the contact pins. Such insulating members are normally formed of synthetic compounds such as phenolic resins or plastic molding compounds to which is added plasticizers, lubricants, accelerators, fillers, and the like and add to the cost of manufacture of the lamp. There is a continuing need for cost reduction in the lamp manufacturing process.

SUMMARY OF THE INVENTION

An object of the invention is to provide an end for an electric lamp that allows for cheaper and more efficient lamp manufacture without decreasing the shear strength of the insulating member.

This object and other objects of the invention are accomplished, according to a first embodiment of the invention in which an electric lamp is provided with an end having an annular recess which contains an insulating member which is secured to the lamp by means of at least two conductors which each extend from the lamp through an aperture in the insulating member, the insulating member and the annular recess being so shaped that the insulating member is held against rotation and lateral displacement with respect to the lamp, and wherein the insulating member comprises cut-out portions in an area remote from the ends thereof, and preferably in a central portion thereof, and most preferably in an area adjacent to the apertures, through which underlying material of said annular recess is exposed.

In a preferred embodiment of the invention, a discharge lamp, preferably a fluorescent lamp, is provided which comprises a metal end having an annular recess which contains an insulating member secured to the lamp by means of at least two conductor pins disposed in side-by-side relationship in the metal end, the annular recess having a substantially rectangular shape with rounded corners and the insulating member contained therein having two substantially octagonal portions connected by a portion in the shape of a parallelogram, each conductor pin extending from the lamp end through an aperture in an octagonal portion of the insulating member, said insulating member and said annular recess being so configured that the insulating member is held in the recess without rotation and lateral displacement with respect to the lamp.

The lamp end with annular recess is preferably formed of a metallic shell stamped out of copper, aluminum, iron or combinations thereof by methods well known in the art.

Similarly, the insulating member is preferably formed of materials well known in the art such as thermosetting resins, and particularly phenolic resins.

It has been found that the insulating members which comprise cut-out portions in an area remote from its ends as described herein may be manufactured without loss in shear strength when compared to prior art insulating members without the cut-out portions. It has also been found that the shear strength of the insulating members with cut-out portions may be further enhanced according to the invention when shear points that result from the cut-out portions are eliminated. This may be simply achieved, for example, by rounding out the sharp edges which constitute shear points of the cut-out portions.

Additionally, it has been found that substantial savings may be realized in the manufacturing process as a result of utilization of the invention. The insulating member can be manufactured by means known in the art, for example, by stamping the same from a sheet of suitable insulating material. The present invention permits a manufacturing process however that utilizes less material and that generates less waste and scrap material. For example, when utilizing an insulating member having the preferred configuration of a disc having double octagonal-shaped portions connected by a central rectangular-shaped portion as illustrated in FIGS. 2, 4 and 5 herein, the area of insulating material necessary to manufacture the insulating member is reduced by approximately 18% when compared to the area of insulating material necessary to manufacture an insulating member having the conventional rectangular configuration. The insulating member according to the present invention removes material from areas of the configuration while maintaining the required functionality of the conventional insulating member with all of its mechanical, electrical, and thermal characteristics. This allows for more efficient use of the raw material with less scrap and permits the manufacture of more insulating members from a standard size sheet of insulating material in an automated process with less hits and passes of the equipment.

BRIEF DESCRIPTION OF THE DRAWINGS

The figures are diagrammatic and not to scale. Corresponding components generally have the same reference numerals.

The invention will be better understood with reference to the details of specific embodiments that follow:

DETAILED DESCRIPTION OF THE PREFERRED EMBODIMENTS

Figure 1:
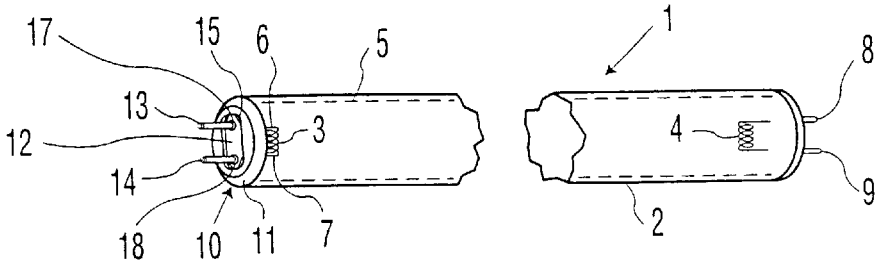
FIG. 1 is a perspective view of an electric lamp having an end with an insulating member.

With reference to FIG. 1, there is illustrated an electric lamp 1, for example a fluorescent lamp, which comprises an elongated tubular or cylindrical envelope 2 having sealed into the ends thereof electrodes 3 and 4 having, if desired, a strip 5 of conductive material, and lead-in wires 6, 7, 8 and 9. A terminal base 10 comprises a metallic cylindrical shell portion 11 having an insulating member in the form of a disc 12 which fills an annular recess 15 and through which terminal contacts 13 and 14 extend from the lamp through apertures 17 and 18, respectively, for connection in a socket (not shown) to a source of current, all as is well known in the art.

Figure 2:
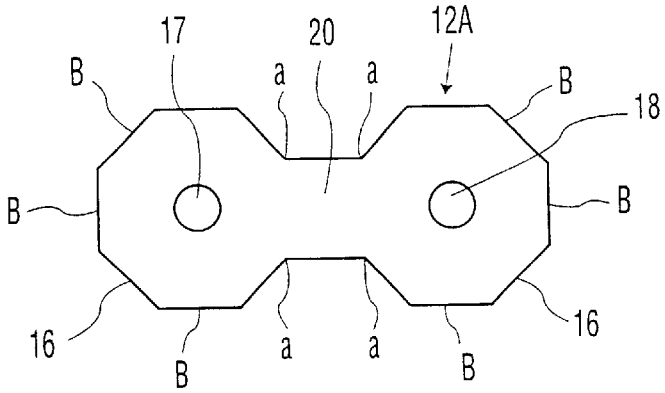
FIG. 2 is a perspective view of an embodiment of an insulating member according to the invention.
Figure 3:
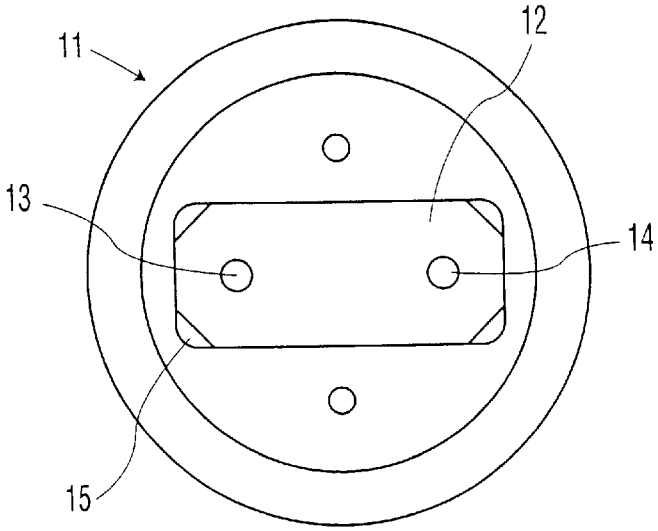
FIG. 3 is an end view of a lamp end having an annular recess and an insulating member according to the prior art.
Figure 4:
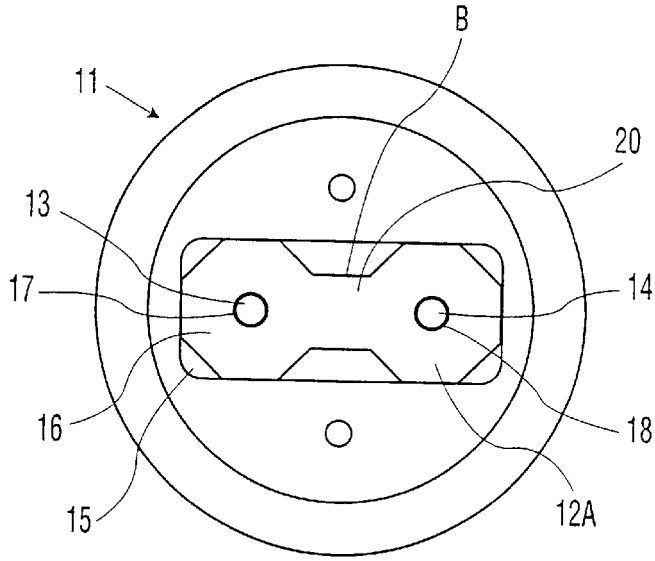
FIG. 4 is an end view of a lamp end having an annular recess and an insulating member according to the prior art.

The insulating member 12 as illustrated in FIGS. 1 and 3 is rectangular in shape and substantially fills the annular recess portion 15 of the end 10. As illustrated in FIGS. 2 and 4, the insulating member 12A of this invention also substantially fills the annular recess 15 but comprises a central area with cut-out portions B which expose portions of the underlying annular recess. Such cut-out portions may be of any number and shape as long as they retain the insulating member in the recess without rotation and lateral displacement with respect to the lamp, and maintain the required functionality, i.e., all of the mechanical, electrical, and thermal characteristics when compared to insulating members that are devoid of said cut-out portions.

FIGS. 2 and 4 illustrate a preferred embodiment of the invention wherein the annular recess 15 has a substantially rectangular shape with rounded corners and the insulating member 12A contained therein has two substantially octagonal portions 16 connected by a portion 20 that has the shape of a parallelogram, each conductor pin 13 and 14 extending from the lamp end 11 through an aperture 17 or 18 in an octagonal portion 16 of the insulating member 12A. Also according to this embodiment of the invention, it has been found that the shear strength of the insulating members with cut-out portions 12A may be further enhanced when shear points that result from the cut-out portions are eliminated.

To illustrate this point, an insulating member having the general shape of that illustrated in FIG. 2 but having a sharp edge or shear point at each of four locations between the transition from the octagonal portion to the parallelogram was designated Disc X and an insulating member in which the design of the insulating member was modified by imposing a radius of, for example about 0.02" to about 0.08", and preferably about a 0.05" radius at these transition locations to eliminate the shear points was designated Disc Y. A torque test was performed on both discs X and Y. Disc X broke at a shear point at a torque of 15 in-lbs. while Disc Y did not break during an average torque of 15 in-lbs. and 23 in.-lbs. While both discs may be used, obviously the version modified to eliminate shear points gives better torque results.

Figure 5:
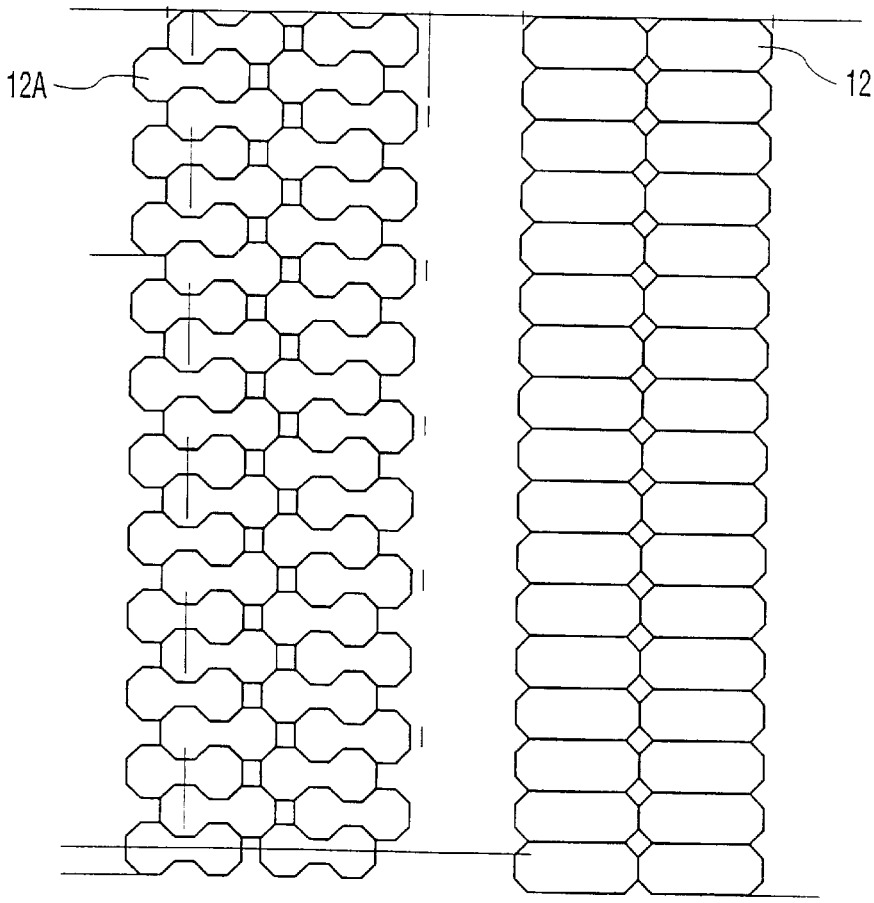
FIG. 5 is a schematic illustrating the increased production and decreased waste that is realized in the production of insulating members of the invention compared to the production of the prior art insulating members.

FIG. 5 illustrates that substantial savings may be realized in the manufacturing process for the insulating member of the invention which may be stamped from a sheet of suitable insulating material. In the Figure approximately 34 insulating members 12 of the conventional design were manufactured from an area of 12.69 sq. in. whereas approximately 44 insulating members 12A were manufactured from an area of 13.97 aq. in.

It will be understood that the insulating member 12A of the invention is not limited to the configuration or shape illustrated and the cut-out portions may be such as to generate other configuration and shapes. The invention may be embodied in other specific forms without departing from the spirit and scope or essential characteristics thereof, the present disclosed examples being only preferred embodiments thereof.

We claim:

1. An electric lamp which comprises a metal end having an annular recess which contains an insulating member secured to the lamp by means of at least two conductor pins disposed in side-by-side relationship in the metal end, the annular recess having a substantially rectangular shape with rounded corners and the insulating member contained therein having cut-out portions configured to have at least two substantially octagonal portions connected by a portion in the shape of a parallelogram, each conductor pin extending from the lamp end through an aperture in an octagonal portion of the insulating member, said insulating member and said annular recess being so configured that the insulating member is held in the recess without rotation and lateral displacement with respect to the lamp.

2. A lamp as claimed in claim 1, wherein said parallelogram is a rectangle.

3. A lamp as claimed in claim 1, wherein said parallelogram is a square.

4. A fluorescent lamp which comprises a metal end having an annular recess which contains an insulating member secured to the lamp by means of at least two conductor pins disposed in side-by-side relationship in the metal end, the annular recess having a substantially rectangular shape with rounded corners and the insulating member contained therein having cut-out portions configured to have two substantially octagonal portions connected by a portion in the shape of a parallelogram, each conductor pin extending from the lamp end through an aperture in an octagonal portion of the insulating member, said insulating member and said annular recess being so configured that the insulating member is held in the recess without rotation and lateral displacement with respect to the lamp.

5. A lamp as claimed in claim 4, wherein said parallelogram is a rectangle.

6. A lamp as claimed in claim 4, wherein said parallelogram is a square.

7. A lamp as claimed in claim 4, wherein said cut-out portions have rounded edges to eliminate shear points.

* * * * *